US011827949B2

(12) United States Patent
Endo et al.

(10) Patent No.: US 11,827,949 B2
(45) Date of Patent: Nov. 28, 2023

(54) MARTENSITIC STAINLESS STEEL SEAMLESS PIPE FOR OIL COUNTRY TUBULAR GOODS, AND METHOD FOR MANUFACTURING SAME

(71) Applicant: JFE Steel Corporation, Tokyo (JP)

(72) Inventors: Mami Endo, Tokyo (JP); Masao Yuga, Tokyo (JP); Yuichi Kamo, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 16/646,347

(22) PCT Filed: Sep. 4, 2018

(86) PCT No.: PCT/JP2018/032684
§ 371 (c)(1),
(2) Date: Mar. 11, 2020

(87) PCT Pub. No.: WO2019/065114
PCT Pub. Date: Apr. 4, 2019

(65) Prior Publication Data

US 2020/0283866 A1 Sep. 10, 2020

(30) Foreign Application Priority Data

Sep. 29, 2017 (JP) ..... 2017-190073

(51) Int. Cl.

| | |
|---|---|
| ***C21D 9/14*** | (2006.01) |
| ***C21D 8/10*** | (2006.01) |
| ***C21D 6/00*** | (2006.01) |
| ***C22C 38/52*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |

(52) U.S. Cl.
CPC ..... *C21D 9/14* (2013.01); *C21D 6/004* (2013.01); *C21D 6/005* (2013.01); *C21D 6/008* (2013.01); *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C21D 2211/008* (2013.01)

(58) Field of Classification Search
CPC .... C21D 1/22; C21D 2211/008; C21D 6/004; C21D 6/005; C21D 6/008; C21D 8/10; C21D 8/105; C21D 9/08; C21D 9/085; C21D 9/14; C22C 38/00; C22C 38/001; C22C 38/002; C22C 38/004; C22C 38/005; C22C 38/02; C22C 38/04; C22C 38/06; C22C 38/42; C22C 38/44; C22C 38/46; C22C 38/48; C22C 38/50; C22C 38/52; C22C 38/54
See application file for complete search history.

(56) References Cited

U.S. PATENT DOCUMENTS

| | | | | |
|---|---|---|---|---|
| 5,512,237 | A | 4/1996 | Stigenberg | |
| 2005/0224143 | A1 | 10/2005 | Takabe et al. | |
| 2009/0017238 | A1* | 1/2009 | Miyata | C21D 9/14 420/36 |
| 2009/0162239 | A1 | 6/2009 | Takabe et al. | |
| 2017/0029912 | A1* | 2/2017 | De Carvalho | C22C 38/06 |
| 2017/0096722 | A1 | 4/2017 | Fujimura et al. | |
| 2019/0136337 | A1* | 5/2019 | Eguchi | C22C 38/22 |
| 2019/0177823 | A1* | 6/2019 | Matsuo | C22C 38/002 |

(Continued)

FOREIGN PATENT DOCUMENTS

| | | | |
|---|---|---|---|
| EP | 3604591 | A1 | 2/2020 |
| JP | 2000160300 | A | 6/2000 |

(Continued)

OTHER PUBLICATIONS

International Search Report and Written Opinion for International Application No. PCT/JP2018/032684, dated Nov. 27, 2018, 6 pages.

(Continued)

*Primary Examiner* — Jenny R Wu

(74) *Attorney, Agent, or Firm* — RATNERPRESTIA

(57) ABSTRACT

The invention provides a martensitic stainless steel seamless pipe for oil country tubular goods having high strength, and excellent sulfide stress corrosion cracking resistance and a method for manufacturing the same. The martensitic stainless steel seamless pipe for oil country tubular goods has a yield stress of 655 to 758 MPa, and has a composition containing, in mass %, C: 0.10% or less, Si: 0.5% or less, Mn: 0.05 to 2.0%, P: 0.030% or less, S: 0.005% or less, Ni: 4.0 to 8.0%, Cu: 0.02% or more and less than 1.0%, Cr: 10.0 to 14.0%, Mo: 1.0 to 3.5%, V: 0.003 to 0.2%, Co: 0.02% or more and less than 1.0%, Al: 0.1% or less, N: 0.1% or less, Ti: 0.50% or less, and the balance Fe and incidental impurities, wherein C, Mn, Cr, Cu, Co, Ni, Mo, W, Nb, N, and Ti satisfy the predetermined relations.

20 Claims, No Drawings

(56) References Cited

U.S. PATENT DOCUMENTS

| | | | | |
|---|---|---|---|---|
| 2019/0241989 | A1* | 8/2019 | Endo | C22C 38/04 |
| 2019/0376157 | A1 | 12/2019 | Kamo et al. | |
| 2020/0216936 | A1 | 7/2020 | Kamo et al. | |
| 2020/0283866 | A1 | 9/2020 | Endo et al. | |

FOREIGN PATENT DOCUMENTS

| | | | | |
|---|---|---|---|---|
| JP | 2000160300 | A | * | 6/2000 |
| JP | 2001026820 | A | | 1/2001 |
| JP | 2001107198 | A | | 4/2001 |
| JP | 2004107773 | A | | 4/2004 |
| JP | 2007332442 | A | | 12/2007 |
| JP | 2010242163 | A | | 10/2010 |
| JP | 2015161010 | A | | 9/2015 |
| JP | 2017040000 | A | | 2/2017 |
| JP | 2017510715 | A | | 4/2017 |
| WO | 2004057050 | A1 | | 7/2004 |
| WO | 2008023702 | A1 | | 2/2008 |
| WO | 2017200083 | A1 | | 11/2017 |
| WO | 2018079111 | A1 | | 5/2018 |
| WO | 2018181404 | A1 | | 10/2018 |

OTHER PUBLICATIONS

Extended European Search Report for European Application No. 18863661.7, dated Jun. 8, 2020, 10 pages.
Japanese Office Action for Japanese Application No. 2018-564432, dated Feb. 5, 2019, with Concise Statement of Relevance of Office Action, 5 pages.

* cited by examiner

MARTENSITIC STAINLESS STEEL SEAMLESS PIPE FOR OIL COUNTRY TUBULAR GOODS, AND METHOD FOR MANUFACTURING SAME

CROSS REFERENCE TO RELATED APPLICATIONS

This is the U.S. National Phase application of PCT/JP2018/032684, filed Sep. 4, 2018, which claims priority to Japanese Patent Application No. 2017-190073, filed Sep. 29, 2017, the disclosures of each of these applications being incorporated herein by reference in their entireties for all purposes.

FIELD OF THE INVENTION

The present invention relates to a martensitic stainless steel seamless pipe for oil country tubular goods for use in crude oil well and natural gas well applications (hereinafter, referred to simply as "oil country tubular goods"), and to a method for manufacturing such a martensitic stainless steel seamless pipe. Particularly, the invention relates to improvement of sulfide stress corrosion cracking resistance (SSC resistance) in a hydrogen sulfide ($H_2S$)-containing environment.

BACKGROUND OF THE INVENTION

Increasing crude oil prices and an expected shortage of petroleum resources in the near future have prompted active development of oil country tubular goods for use in applications that were unthinkable in the past, for example, such as in deep oil fields, and in oil fields and gas oil fields of severe corrosive environments containing carbon dioxide gas, chlorine ions, and hydrogen sulfide. The material of steel pipes for oil country tubular goods intended for these environments require high strength, and excellent corrosion resistance.

Oil country tubular goods used for mining of oil fields and gas fields of an environment containing carbon dioxide gas, chlorine ions, and the like typically use 13% Cr martensitic stainless steel pipes. There has also been global development of oil fields in very severe corrosive environments containing hydrogen sulfide. Accordingly, the need for SSC resistance is high, and there has been increasing use of an improved 13% Cr martensitic stainless steel pipe of a reduced C content and increased Ni and Mo contents.

PTL 1 describes a composition using a 13% Cr-base steel as a basic composition, in which C is contained in a much smaller content than in common stainless steels, and Ni, Mo, and Cu are contained so as to satisfy $Cr+2Ni+1.1Mo+0.7Cu \leq 32.5$. The composition also contains at least one of Nb: 0.20% or less, and V: 0.20% or less so as to satisfy the condition $Nb+V \geq 0.05\%$. It is stated in PTL 1 that this will provide high strength with a yield stress of 965 MPa or more, high toughness with a Charpy absorption energy at −40° C. of 50 J or more, and desirable corrosion resistance.

PTL 2 describes a 13% Cr-base martensitic stainless steel pipe of a composition containing carbon in an ultra low content of 0.015% or less, and 0.03% or more of Ti. It is stated in PTL 2 that this stainless steel pipe has high strength with a yield stress on the order of 95 ksi, low hardness with an HRC of less than 27, and excellent SSC resistance. PTL 3 describes a martensitic stainless steel that satisfies $6.0 \leq Ti/C \leq 10.1$, based on the finding that Ti/C has a correlation with a value obtained by subtracting a yield stress from a tensile stress. It is stated in PTL 3 that this technique, with a value of 20.7 MPa or more yielded as the difference between tensile stress and yield stress, can reduce hardness variation that impairs SSC resistance.

PTL 4 describes a martensitic stainless steel containing Mo in a limited content of $Mo \geq 2.3-0.89Si+32.2C$, and having a metal microstructure composed mainly of tempered martensite, carbides that have precipitated during tempering, and intermetallic compounds such as a Laves phase and a δ phase formed as fine precipitates during tempering. It is stated in PTL 4 that the steel produced by this technique provides has high strength with a 0.2% proof stress of 860 MPa or more, and excellent carbon dioxide corrosion resistance and sulfide stress corrosion cracking resistance.

PATENT LITERATURE

PTL 1: JP-A-2007-332442
PTL 2: JP-A-2010-242163
PTL 3: WO2008/023702
PTL 4: WO2004/057050

SUMMARY OF THE INVENTION

The development of recent oil fields and gas fields is made in severe corrosive environments containing $CO_2$, $Cl^-$, and $H_2S$. Increasing $H_2S$ concentrations due to aging of oil fields and gas fields are also of concern. Steel pipes for oil country tubular goods for use in these environments are therefore required to have excellent sulfide stress corrosion cracking resistance (SSC resistance). However, the technique described in PTL 1, which describes a steel having excellent corrosion resistance against $CO_2$, does not take into account sulfide stress corrosion cracking resistance, and it cannot be said that the steel has corrosion resistance against a severe corrosive environment.

PTL 2 states that sulfide stress cracking resistance can be maintained under an applied stress of 655 MPa in an atmosphere of a 5% NaCl aqueous solution ($H_2S$: 0.10 bar) having an adjusted pH of 3.5. The steel described in PTL 3 has sulfide stress cracking resistance in an atmosphere of a 20% NaCl aqueous solution ($H_2S$: 0.03 bar, $CO_2$ bal.) having an adjusted pH of 4.5. The steel described in PTL 4 has sulfide stress cracking resistance in an atmosphere of a 25% NaCl aqueous solution ($H_2S$: 0.03 bar, $CO_2$ bal.) having an adjusted pH of 4.0. However, these patent applications do not take into account sulfide stress corrosion cracking resistance in other atmospheres, and it cannot be said that the steels described in these patent applications have the level of sulfide stress corrosion cracking resistance that can withstand the today's ever demanding severe corrosive environments.

It is accordingly an object of the present invention to provide a martensitic stainless steel seamless pipe for oil country tubular goods having high strength and excellent sulfide stress corrosion cracking resistance. The invention is also intended to provide a method for manufacturing such a martensitic stainless steel seamless pipe.

As used herein, "high strength" means a yield stress of 655 MPa or more and 758 MPa or less, preferably 655 MPa or more and less than 758 MPa.

As used herein, "excellent sulfide stress corrosion cracking resistance" means that a test piece dipped in a test solution (a 0.165 mass % NaCl aqueous solution; liquid temperature: 25° C.; $H_2S$: 1 bar; $CO_2$ bal.) having an adjusted pH of 3.5 with addition of sodium acetate and hydrochloric acid does not crack even after 720 hours under an applied stress equal to 90% of the yield stress.

In order to achieve the foregoing objects, the present inventors conducted intensive studies of the effects of various alloy elements on sulfide stress corrosion cracking resistance (SSC resistance) in a $CO_2$, $Cl^-$-, and $H_2S$-containing corrosive environment, using a 13% Cr-base stainless steel pipe as a basic composition. The studies found that a martensitic stainless steel seamless pipe for oil country tubular goods having the desired strength, and excellent SSC resistance in a $CO_2$, $Cl^-$-, and $H_2S$-containing corrosive environment, and in an environment under an applied stress close to the yield stress can be provided when the steel contains Cu and Co in predetermined ranges, and is subjected to an appropriate heat treatment.

The present invention is based on this finding, and was completed after further studies. Specifically, the gist of the exemplary embodiments of the present invention is as follows.

[1] A martensitic stainless steel seamless pipe for oil country tubular goods having a yield stress of 655 to 758 MPa, the martensitic stainless steel seamless pipe having a composition comprising, in mass %, C: 0.10% or less, Si: 0.5% or less, Mn: 0.05 to 2.0%, P: 0.030% or less, S: 0.005% or less, Ni: 4.0 to 8.0%, Cu: 0.02% or more and less than 1.0%, Cr: 10.0 to 14.0%, Mo: 1.0 to 3.5%, V: 0.003 to 0.2%, Co: 0.02% or more and less than 1.0%, Al: 0.1% or less, N: 0.1% or less, Ti: 0.50% or less, and the balance Fe and incidental impurities, and satisfying the following formulae (1) and (2):

$$-15 \leq -109.37C+7.307Mn+6.399Cr+6.329Cu+11.343Ni-13.529Mo+1.276W+2.925Nb+196.775N-2.621Ti-120.307 \leq 30 \quad \text{Formula (1)}$$

$$-0.20 \leq -1.324C+0.0533Mn+0.0268Cr+0.0893Cu+0.0623Co+0.00526Ni+0.0222Mo-0.0132W-0.473N-0.5Ti-0.514 \leq 0.20 \quad \text{Formula (2)}$$

In the formulae, C, Mn, Cr, Cu, Co, Ni, Mo, W, Nb, N, and Ti represent the content of each element in mass %, and the content is 0 (zero) for elements that are not contained.

[2] The martensitic stainless steel seamless pipe for oil country tubular goods having a yield stress of 655 to 758 MPa according to item [1], wherein the composition further comprises, in mass %, at least one selected from Nb: 0.1% or less, and W: 1.0% or less.

[3] The martensitic stainless steel seamless pipe for oil country tubular goods having a yield stress of 655 to 758 MPa according to item [1] or [2], wherein the composition further comprises, in mass %, one or more selected from Ca: 0.005% or less, REM: 0.010% or less, Mg: 0.010% or less, and B: 0.010% or less.

[4] A method for manufacturing a martensitic stainless steel seamless pipe for oil country tubular goods having a yield stress of 655 to 758 MPa, the method comprising:

forming a steel pipe from a steel pipe material of the composition of any one of items [1] to [3];

quenching the steel pipe by heating the steel pipe to a temperature equal to or greater than an $Ac_3$ transformation point, and cooling the steel pipe to a temperature of 100° C. or less; and tempering the steel pipe at a temperature of 550 to 680° C.

[5] The method for manufacturing a martensitic stainless steel seamless pipe for oil country tubular goods according to claim 4, wherein the quenching that heats the steel pipe to a temperature equal to or greater than an $Ac_3$ transformation point, and that cools the steel pipe to a temperature of 100° C. or less involves a cooling rate of 0.05° C./s or more.

The exemplary embodiments of the present invention has enabled production of a martensitic stainless steel seamless pipe for oil country tubular goods having excellent sulfide stress corrosion cracking resistance (SSC resistance) in a $CO_2$, $Cl^-$-, and $H_2S$-containing corrosive environment, and high strength with a yield stress YS of 655 MPa (95 ksi) or more and 758 MPa or less, preferably less than 758 MPa.

DETAILED DESCRIPTION OF EMBODIMENTS OF THE INVENTION

The following describes the reasons for specifying the composition of a steel pipe of the present invention. In the following, "%" means percent by mass, unless otherwise specifically stated.

C: 0.10% or Less

C is an important element involved in the strength of the martensitic stainless steel, and is effective at improving strength. However, when C is contained in an amount of more than 0.10%, the hardness becomes excessively high, and susceptibility to sulfide stress corrosion cracking increases. For this reason, the C content is limited to 0.10% or less in an embodiment of the present invention. Preferably, the C content is 0.05% or less. In order to provide the desired strength, it is desirable to contain C in an amount of 0.005% or more.

Si: 0.5% or Less

Si acts as a deoxidizing agent, and is contained in an amount of desirably 0.05% or more. A Si content of more than 0.5% impairs carbon dioxide corrosion resistance and hot workability. For this reason, the Si content is limited to 0.5% or less. Preferably, the Si content is 0.10 to 0.3%.

Mn: 0.05 to 2.0%

Mn is an element that improves hot workability, and is contained in an amount of 0.05% or more. When Mn is contained in an amount of more than 2.0%, the effect becomes saturated, and the cost increases. For this reason, the Mn content is limited to 0.05 to 2.0%. Preferably, the Mn content is 1.5% or less.

P: 0.030% or Less

P is an element that impairs carbon dioxide corrosion resistance, pitting corrosion resistance, and sulfide stress corrosion cracking resistance, and should desirably be contained in as small an amount as possible in the present invention. However, an excessively small P content increases the manufacturing cost. For this reason, the P content is limited to 0.030% or less, which is a content range that does not cause a severe impairment of characteristics, and that is economically practical in industrial applications. Preferably, the P content is 0.020% or less.

S: 0.005% or Less

S is an element that seriously impairs hot workability, and should desirably be contained in as small an amount as possible. A reduced S content of 0.005% or less enables pipe production using an ordinary process, and the S content is limited to 0.005% or less in an embodiment of the present invention. Preferably, the S content is 0.003% or less.

Ni: 4.0 to 8.0%

When contained in an amount of 4.0% or more, Ni increases the strength of the protective coating, and improves the corrosion resistance. Ni also increases steel strength by forming a solid solution. With a Ni content of more than 8.0%, the martensite phase becomes less stable, and the strength decreases. For this reason, the Ni content is limited to 4.0 to 8.0%. Preferably, the Ni content is 7.0% or less.

Cu: 0.02% or More and Less than 1.0%

Cu is contained in an amount of 0.02% or more to increase the strength of the protective coating, and improve sulfide stress corrosion cracking resistance. However, when contained in an amount of 1.0% or more, Cu precipitates into CuS, and impairs hot workability. For this reason, the Cu content is less than 1.0%. When contained with Co, Cu reduces hydrogen embrittlement, and improves the sulfide stress corrosion cracking resistance. The Cu content is more preferably 0.03 to 0.6%.

Cr: 10.0 to 14.0%

Cr is an element that forms a protective coating, and improves the corrosion resistance. The required corrosion resistance for oil country tubular goods can be provided when Cr is contained in an amount of 10.0% or more. A Cr content of more than 14.0% facilitates ferrite generation, and a stable martensite phase cannot be provided. For this reason, the Cr content is limited to 10.0 to 14.0%. Preferably, the Cr content is 11.5 to 13.5%.

Mo: 1.0 to 3.5%

Mo is an element that improves the resistance against pitting corrosion by $Cl^-$. Mo needs to be contained in an amount of 1.0% or more to obtain the corrosion resistance necessary for a severe corrosive environment. When Mo is contained in an amount of more than 3.5%, the effect becomes saturated. Mo is also an expensive element, and such a high Mo content increases the manufacturing cost. For this reason, the Mo content is limited to 1.0 to 3.5%. Preferably, the Mo content is 1.2 to 3.0%.

V: 0.003 to 0.2%

V needs to be contained in an amount of 0.003% or more to improve steel strength through precipitation hardening, and to improve sulfide stress corrosion cracking resistance. Because a V content of more than 0.2% impairs toughness, the V content is limited to 0.2% or less in an embodiment of the present invention. Preferably, the V content is 0.08% or less.

Co: 0.02% or More and Less than 1.0%

Co is an element that improves the pitting corrosion resistance, and is contained in an amount of 0.02% or more. However, an excessively high Co content may impair toughness, and increases the material cost. For this reason, the Co content is limited to 0.02% or more and less than 1.0%. When contained with Cu, Co reduces hydrogen embrittlement, and improves the sulfide stress corrosion cracking resistance. The Co content is more preferably 0.03 to 0.6%.

Al: 0.1% or Less

Al acts as a deoxidizing agent, and an Al content of 0.01% or more is effective for obtaining this effect. However, Al has an adverse effect on toughness when contained in an amount of more than 0.1%. For this reason, the Al content is limited to 0.1% or less in an embodiment of the present invention. Preferably, the Al content is 0.01 to 0.03%.

N: 0.1% or Less

N is an element that greatly improves pitting corrosion resistance. However, N forms various nitrides, and impairs toughness when contained in an amount of more than 0.1%. For this reason, the N content is limited to 0.1% or less in an embodiment of the present invention. Preferably, the N content is 0.003% or more. The N content is more preferably 0.004 to 0.08%, further preferably 0.005 to 0.05%.

Ti: 0.50% or Less

Ti forms carbides, and can reduce hardness by reducing solid-solution carbon. However, the Ti content is limited to 0.50% or less, preferably 0.30% or less, because an excessively high Ti content may impair toughness.

In an embodiment of the present invention, C, Mn, Cr, Cu, Co, Ni, Mo, W, Nb, N, and Ti are contained so as to satisfy the following formulae (1) and (2).

Formula (1) correlates these elements with an amount of retained y. The retained austenite occurs in smaller amounts, and the hardness decreases when the value of formula (1) is 30 or less. This improves the sulfide stress corrosion cracking resistance. When the value of formula (1) is less than −15, the amount of retained austenite remains the same, and the toughness decreases. The formula (2) correlates the elements with pitting corrosion potential. By containing C, Mn, Cr, Cu, Co, Ni, Mo, W, N, and Ti so as to satisfy the predetermined range, it is possible to reduce generation of pitting corrosion, which becomes an initiation point of sulfide stress corrosion cracking, and to greatly improve sulfide stress corrosion cracking resistance.

$$-15 \leq -109.37C+7.307Mn+6.399Cr+6.329Cu+11.343Ni-13.529Mo+1.276W+2.925Nb+196.775N-2.621Ti-120.307 \leq 30 \quad \text{Formula (1)}$$

$$-0.20 \leq -1.324C+0.0533Mn+0.0268Cr+0.0893Cu+0.0623Co+0.00526Ni+0.0222Mo-0.0132W-0.473N-0.5Ti-0.514 \leq 0.20 \quad \text{Formula (2)}$$

In the formulae, C, Mn, Cr, Cu, Co, Ni, Mo, W, Nb, N, and Ti represent the content of each element in mass %, and the content is 0 (zero) for elements that are not contained.

At least one selected from Nb: 0.1% or less, and W: 1.0% or less may be contained as optional elements, as needed.

Nb forms carbides, and can reduce hardness by reducing solid-solution carbon. However, Nb may impair toughness when contained in an excessively large amount. For this reason, Nb, when contained, is contained in a limited amount of 0.1% or less.

W is an element that improves pitting corrosion resistance. However, W may impair toughness, and increases the material cost when contained in an excessively large amount. For this reason, W, when contained, is contained in a limited amount of 1.0% or less.

One or more selected from Ca: 0.005% or less, REM: 0.010% or less, Mg: 0.010% or less, and B: 0.010% or less may be contained as optional elements, as needed.

Ca, REM, Mg, and B are elements that improve corrosion resistance by controlling the form of inclusions. The desired contents for providing this effect are Ca: 0.0005% or more, REM: 0.0005% or more, Mg: 0.0005% or more, and B: 0.0005% or more. Ca, REM, Mg, and B impair toughness and carbon dioxide corrosion resistance when contained in amounts of more than Ca: 0.005%, REM: 0.010%, Mg: 0.010%, and B: 0.010%. For this reason, the contents of Ca, REM, Mg, and B, when contained, are limited to Ca: 0.005% or less, REM: 0.010% or less, Mg: 0.010% or less, and B: 0.010% or less.

The balance is Fe and incidental impurities in the composition.

The following describes a preferred method for manufacturing a martensitic stainless steel seamless pipe for oil country tubular goods of the present invention.

In the present invention, a steel pipe material of the foregoing composition is used. However, the method of production of a stainless steel seamless pipe used as a steel pipe material is not particularly limited, and any known seamless steel pipe manufacturing method may be used.

Preferably, a molten steel of the foregoing composition is made into steel using an ordinary steel making process such as by using a converter, and formed into a steel pipe material, for example, a billet, using a method such as continuous casting, or ingot casting-blooming. The steel pipe material is then heated, and hot worked into a pipe using a known pipe manufacturing process, for example, the Mannesmann-plug mill process, or the Mannesmann-mandrel mill process to produce a seamless steel pipe of the foregoing composition.

The process after the production of the steel pipe from the steel pipe material is not particularly limited. Preferably, the steel pipe is subjected to quenching in which the steel pipe is heated to a temperature equal to or greater than an $Ac_3$ transformation point, and cooled to a cooling stop temperature of 100° C. or less, followed by tempering at a temperature of 550 to 680° C.

Quenching

In an embodiment of the present invention, the steel pipe is reheated to a temperature equal to or greater than an $Ac_3$ transformation point, held for preferably at least 5 min, and cooled to a cooling stop temperature of 100° C. or less. This makes it possible to produce a refined, tough martensite phase. When the heating temperature is less than an $Ac_3$ transformation point, the microstructure does not occur in the austenite single-phase region, and a sufficient martensite microstructure does not occur in the subsequent cooling, with the result that the desired high strength cannot be obtained. For this reason, the quenching heating temperature is limited to a temperature equal to or greater than an $Ac_3$ transformation point. The cooling method is not particularly limited. Typically, the steel pipe is air cooled (at a cooling rate of 0.05° C./s or more and 20° C./s or less) or water cooled (at a cooling rate of 5° C./s or more and 100° C./s or less), and the cooling rate conditions are not limited either. However, the cooling rate is preferably 0.05° C./s or more from the standpoint of improving corrosion resistance through refinement of the microstructure. The $Ac_3$ transformation point (° C.) can be obtained by giving a heating and cooling temperature history to the test piece, and measuring the transformation point from a microdisplacement due to expansion and contraction.

Tempering

The quenched steel pipe is tempered. The tempering is a process in which the steel pipe is heated to 550 to 680° C., held for preferably at least 10 min, and air cooled. With a tempering temperature of less than 550° C., the tempering effect cannot be expected, and the desired strength cannot be achieved. With a high tempering temperature of more than 680° C., the martensite phase precipitates after the tempering, and the desired high toughness and corrosion resistance cannot be provided. For this reason, the tempering temperature is limited to 680° C. or less. The tempering temperature is preferably 605° C. or more and 640° C. or less.

Examples

The present invention is further described below through Examples.

Molten steels containing the components shown in Table 1 were made into steel with a converter, and cast into billets (steel pipe material) by continuous casting. The billet was hot worked into a pipe with a model seamless rolling mill, and cooled by air cooling or water cooling to produce a seamless steel pipe measuring 83.8 mm in outer diameter and 12.7 mm in wall thickness.

Each seamless steel pipe was cut to obtain a test material, which was then subjected to quenching and tempering under the conditions shown in Table 2. An arc-shaped tensile test specimen specified by API standard was taken from the quenched and tempered test material, and the tensile properties (yield stress, YS; tensile strength, TS) were determined in a tensile test conducted according to the API specification. The $Ac_3$ transformation point (° C.) in Table 2 was determined by measuring a microdisplacement due to the expansion and contraction of a test piece ($\phi$=4 mm×10 mm) taken from the steel pipe. Specifically, the test piece was heated to 500° C. at 5° C./s, and, after increasing the temperature to 920° C. at 0.25° C./s, the expansion and contraction of the test piece with this temperature history were detected to obtain the $Ac_3$ transformation point (° C.).

The SSC test was conducted according to NACE TM0177, Method A. A test environment was created by adjusting the pH of a test solution (a 0.165 mass % NaCl aqueous solution; liquid temperature: 25° C.; $H_2S$: 1 bar; $CO_2$ bal.) to 3.5 with addition of 0.41 g/L of $CH_3COONa$ and HCl, and a stress 90% of the yield stress was applied under a hydrogen sulfide partial pressure of 0.1 MPa for 720 hours in the solution. Samples were determined as being acceptable when there was no crack in the test piece after the test, and unacceptable when the test piece had a crack after the test.

The results are presented in Table 2.

TABLE 1

(mass %)

| Steel No. | C | Si | Mn | P | S | Cr | Mo | Ni | Cu | Co | V | Ti | Al | N |
|---|---|---|---|---|---|---|---|---|---|---|---|---|---|---|
| A | 0.019 | 0.19 | 0.65 | 0.018 | 0.001 | 12.4 | 1.2 | 6.6 | 0.03 | 0.04 | 0.004 | 0.11 | 0.051 | 0.0045 |
| B | 0.010 | 0.20 | 0.45 | 0.015 | 0.002 | 10.9 | 1.6 | 5.4 | 0.45 | 0.03 | 0.003 | 0.12 | 0.046 | 0.0112 |
| C | 0.028 | 0.18 | 0.78 | 0.013 | 0.001 | 13.2 | 2.5 | 4.9 | 0.03 | 0.38 | 0.004 | 0.22 | 0.042 | 0.0068 |
| D | 0.012 | 0.14 | 0.56 | 0.009 | 0.001 | 13.4 | 2.7 | 4.9 | 0.03 | 0.04 | 0.055 | 0.08 | 0.040 | 0.0071 |
| E | 0.005 | 0.19 | 1.28 | 0.021 | 0.001 | 13.8 | 3.0 | 6.3 | 0.52 | 0.56 | 0.005 | 0.07 | 0.044 | 0.0087 |
| F | 0.018 | 0.21 | 0.26 | 0.018 | 0.001 | 13.1 | 1.5 | 4.5 | 0.03 | 0.41 | 0.026 | 0.14 | 0.045 | 0.0096 |
| G | 0.009 | 0.20 | 0.66 | 0.017 | 0.001 | 13.2 | 2.6 | 4.4 | 0.33 | 0.02 | 0.035 | 0.11 | 0.036 | 0.0133 |
| H | 0.039 | 0.25 | 0.24 | 0.015 | 0.001 | 12.2 | 2.1 | 5.3 | 0.26 | 0.18 | 0.039 | 0.08 | 0.048 | 0.0087 |
| I | 0.11 | 0.32 | 0.95 | 0.016 | 0.002 | 13.4 | 2.9 | 6.4 | 0.32 | 0.44 | 0.044 | 0.13 | 0.055 | 0.0165 |
| J | 0.008 | 0.11 | 0.36 | 0.015 | 0.001 | 13.5 | 1.7 | 6.2 | 1.23 | 0.04 | 0.007 | 0.09 | 0.062 | 0.0113 |
| K | 0.007 | 0.18 | 0.42 | 0.017 | 0.001 | 13.2 | 1.6 | 6.4 | 0.42 | 1.16 | 0.042 | 0.11 | 0.058 | 0.0076 |
| L | 0.023 | 0.17 | 0.92 | 0.015 | 0.001 | 13.3 | 2.7 | 6.9 | 0.76 | 0.66 | 0.045 | 0.51 | 0.046 | 0.0043 |
| M | 0.009 | 0.19 | 0.30 | 0.018 | 0.001 | 10.9 | 2.4 | 5.5 | 0.42 | 0.05 | 0.044 | 0.12 | 0.036 | 0.0093 |
| N | 0.025 | 0.25 | 0.24 | 0.012 | 0.001 | 12.1 | 1.4 | 4.4 | 0.05 | 0.03 | 0.045 | 0.11 | 0.047 | 0.0064 |

TABLE 1-continued

| (mass %) Steel No. | Nb | W | Others | (mass %) Value of formula (1) (*1) | Value of formula (2) (*2) | Remarks |
|---|---|---|---|---|---|---|
| A | — | — | — | 21.1 | −0.163 | Compliant Example |
| B | 0.05 | — | REM: 0.0049 | −3.9 | −0.170 | Compliant Example |
| C | — | 0.32 | B: 0.0018 | −10.1 | −0.166 | Compliant Example |
| D | — | — | Ca: 0.0008 | −11.4 | −0.093 | Compliant Example |
| E | — | 0.46 | — | 13.1 | 0.053 | Compliant Example |
| F | — | — | — | −4.1 | −0.162 | Compliant Example |
| G | 0.09 | — | — | −12.6 | −0.087 | Compliant Example |
| H | — | — | Mg: 0.0024 | −9.9 | −0.161 | Compliant Example |
| I | — | — | — | −1.4 | −0.169 | Comparative Example |
| J | — | — | — | 24.9 | −0.011 | Comparative Example |
| K | — | — | — | 21.3 | −0.027 | Comparative Example |
| L | — | — | — | 15.1 | −0.191 | Comparative Example |
| M | — | — | — | −15.3 | −0.159 | Comparative Example |
| N | — | — | — | −11.6 | −0.207 | Comparative Example |

* Underline means outside the range of the invention

* The remainder is Fe and incidental impurities (*1) Formula (1): −109.37C + 7.307Mn + 6.399Cr + 6.329Cu + 11.343Ni − 13.529Mo + 1.276W + 2.925Nb + 196.775N − 2.621Ti − 120.307

(*2) Formula (2): −1.324C + 0.0533Mn + 0.0268Cr + 0.0893Cu + 0.0623Co + 0.00526Ni + 0.0222Mo − 0.0132W − 0.473N − 0.5Ti − 0.514

TABLE 2

| | | Quenching | | | | Tempering | | | | | | |
|---|---|---|---|---|---|---|---|---|---|---|---|---|
| No. | Steel No. | $AC_3$ transformation point (° C.) | Heating temperature (° C.) | Cooling method | Cooling rate (° C./s) | Cooling stop temperature (° C.) | Heating temperature (° C.) | Holding time (min) | Yield stress YS (MPa) | Tensile strength TS (MPa) | SSC test | Remarks |
| 1 | A | 833 | 920 | Air cooling | 0.5 | 25 | 620 | 60 | 685 | 805 | Acceptable | Present Example |
| 2 | B | 762 | 880 | Air cooling | 0.4 | 25 | 620 | 60 | 725 | 812 | Acceptable | Present Example |
| 3 | C | 745 | 880 | Air cooling | 0.5 | 25 | 630 | 60 | 713 | 803 | Acceptable | Present Example |
| 4 | D | 710 | 850 | Air cooling | 0.5 | 25 | 620 | 60 | 692 | 795 | Acceptable | Present Example |
| 6 | E | 723 | 880 | Air cooling | 0.1 | 25 | 640 | 60 | 684 | 783 | Acceptable | Present Example |
| 8 | G | 715 | 880 | Air cooling | 0.6 | 25 | 620 | 60 | 715 | 817 | Acceptable | Present Example |
| 10 | I | 730 | 920 | Air cooling | 0.5 | 25 | 620 | 60 | 687 | 787 | Unacceptable | Comparative Example |
| 11 | J | 783 | 930 | Air cooling | 0.2 | 25 | 620 | 60 | 695 | 793 | Unacceptable | Comparative Example |
| 12 | K | 823 | 930 | Air cooling | 0.7 | 25 | 620 | 60 | 692 | 811 | Unacceptable | Comparative Example |
| 13 | L | 787 | 920 | Air cooling | 0.3 | 25 | 620 | 60 | 714 | 823 | Unacceptable | Comparative Example |
| 15 | M | 710 | 880 | Air cooling | 0.5 | 25 | 620 | 60 | 722 | 821 | Unacceptable | Comparative Example |
| 16 | N | 730 | 880 | Air cooling | 0.4 | 25 | 620 | 60 | 686 | 795 | Unacceptable | Comparative Example |
| 17 | D | 710 | 850 | Water cooling | 30 | 25 | 605 | 60 | 742 | 817 | Acceptable | Present Example |
| 18 | F | 750 | 920 | Air cooling | 0.1 | 25 | 615 | 60 | 688 | 794 | Acceptable | Present Example |
| 19 | H | 728 | 920 | Air cooling | 0.3 | 25 | 610 | 60 | 732 | 796 | Acceptable | Present Example |

* Underline means outside the range of the invention

The steel pipes of the present examples all had high strength with a yield stress of 655 MPa or more and 758 MPa or less, demonstrating that the steel pipes were martensitic stainless steel seamless pipes having excellent SSC resistance that do not crack even when placed under a stress in a $H_2S$-containing environment. On the other hand, in Comparative Examples outside the range of the present invention, the steel pipes did not have desirable SSC resistance, even though the desired high strength was obtained.

The invention claimed is:

1. A martensitic stainless steel seamless pipe for oil country tubular goods, the martensitic stainless steel seamless pipe having a composition comprising, in mass %, C: 0.10% or less, Si: 0.5% or less, Mn: 0.35 to 2.0%, P: 0.030% or less, S: 0.005% or less, Ni: 4.0 to 8.0%, Cu: 0.02% or more and less than 1.0%, Cr: 10.0 to 14.0%, Mo: 1.0 to 3.5%, V: 0.003 to 0.2%, Co: 0.02% or more and less than 0.9%, Al: 0.1% or less, N: 0.1% or less, Ti: 0.50% or less, and the balance Fe and incidental impurities, and satisfying the following formulae (1) and (2):

$$-15 \leq -109.37C+7.307Mn+6.399Cr+6.32Cu+11.343Ni-13.529Mo+1.276W+2.925Nb+196.775N-2.621Ti-120.307 \leq 30, \quad \text{Formula (1)}$$

$$-0.20 \leq -1.324C+0.0533Mn+0.0268Cr+0.0893Cu+0.0623Co+0.00526Ni+0.0222Mo-0.0132W-0.473N-0.5Ti-0.514 \leq 20, \quad \text{Formula (2)}$$

wherein C, Mn, Cr, Cu, Co, Ni, Mo, W, Nb, N, and Ti represent the content of each element in mass %, and the content is 0 (zero) for elements that are not contained, and wherein the martensitic stainless steel seamless pipe does not crack when subjected to a sulfide stress corrosion test according to NACE TM0177 Method A, using a 0.165 mass % NaCl aqueous solution with a liquid temperature of 25° C., $H_2S$: 1 bar and $CO_2$ bal., the NaCl solution adjusted to a pH of 3.5 with addition of 0.41 g/L of $CH_3COONa$ and HCl, and applying a stress of 90% of the yield stress under a hydrogen sulfide partial pressure of 0.1 MPa for 720 hours in the NaCl solution, wherein the martensitic stainless steel seamless pipe has a yield stress of 655 MPa or more and 750 MPa or less.

2. The martensitic stainless steel seamless pipe for oil country tubular goods according to claim 1, wherein the composition further comprises, in mass %, one or two selected from Nb: 0.1% or less, and W: 1.0% or less.

3. The martensitic stainless steel seamless pipe for oil country tubular goods according to claim 1, wherein the composition further comprises, in mass %, one, two or more selected from Ca: 0.005% or less, REM: 0.010% or less, Mg: 0.010% or less, and B: 0.010% or less.

4. A method for manufacturing a martensitic stainless steel seamless pipe for all country tubular goods according to claim 1, the method comprising:

forming a steel pipe from a steel pipe material of the composition of claim 1;

quenching the steel pipe by heating the steel pipe to a temperature equal to or greater than an $Ac_3$ transformation point, and cooling the steel pipe to a temperature of 190° C. or less;

and tempering the steel pipe at a temperature of 550 to 680° C.; thereby producing martensitic stainless steel seamless pipe of claim 1.

5. The method for manufacturing a martensitic stainless steel seamless pipe for oil country tubular goods according to claim 4, wherein the quenching that heats the steel pipe to a temperature equal to or greater than an $Ac_3$ transformation point, and that cools the steel pipe to a temperature of 100° C. or less involves a cooling rate of 0.05° C./s or more.

6. The martensitic stainless steel seamless pipe for oil country tubular goods according to claim 2, wherein the composition further comprises, in mass %, one, two or more selected from Ca: 0,005% or less, REM: 0.010% or less, Mg: 0.010% or less, and B: 0.010% or less.

7. A method for manufacturing a martensitic stainless steel seamless pipe for oil country tubular goods according to claim 2, the method comprising:

forming a steel pipe from a steel pipe material of the composition of claim 2;

quenching the steel pipe by heating the steel pipe to a temperature equal to or greater than an $Ac_3$ transformation point, and cooling the steel pipe to a temperature of 100° C. or less; and tempering the steel pipe at a temperature of 550 to 680° C.

8. A method for manufacturing a martensitic stainless steel seamless pipe for oil country tubular goods according to claim 3, the method comprising:

forming a steel pipe from a steel pipe material of the composition of claim 3;

quenching the steel pipe by heating the steel pipe to a temperature equal to or greater than an $Ac_3$ transformation point, and cooling the steel pipe to a temperature of 100° C. or less; and tempering the steel pipe at a temperature of 550 to 680° C.

9. A method for manufacturing a martensitic stainless steel seamless pipe for oil country tubular goods according to claim 6, the method comprising:

forming a steel pipe from a steel pipe material of the composition of claim 6;

quenching the steel pipe by heating the steel pipe to a temperature equal to or greater than an $Ac_3$ transformation point, and cooling the steel pipe to a temperature of 100° C. or less; and tempering the steel pipe at a temperature of 550 to 680° C.

10. The method for manufacturing a martensitic stainless steel seamless pipe for oil country tubular goods according to claim 7, wherein the quenching that heats the steel pipe to a temperature equal to or greater than an $Ac_3$ transformation point, and that cools the steel pipe to a temperature of 100° C. or less involves a cooling rate of 0.05° C./s or more.

11. The method for manufacturing a martensitic stainless steel seamless pipe for oil country tubular goods according to claim 8, wherein the quenching that heats the steel pipe to a temperature equal to or greater than an $Ac_3$ transformation point, and that cools the steel pipe to a temperature of 100° C. or less involves a cooling rate of 0.05° C./s or more.

12. The method for manufacturing a martensitic stainless steel seamless pipe for oil country tubular goods according to claim 9, wherein the quenching that heats the steel pipe to a temperature equal to or greater than an $Ac_3$ transformation point, and that cools the steel pipe to a temperature of 100° C. or less involves a cooling rate of 0.05° C./s or more.

13. The martensitic stainless steel seamless pipe for oil country tubular goods according to claim 1, wherein the yield stress is 655 MPa or more and 742 MPa or less.

14. The martensitic stainless steel seamless pipe for oil country tubular goods according to claim 1, wherein the Co is 0.02% or more and 0.6% or less.

15. The martensitic stainless steel seamless pipe for oil country tubular goods according to claim 13, wherein the Co is 0.02% or more and 0.6% or less.

16. The martensitic stainless steel seamless pipe for oil country tubular goods according to claim 1, wherein the Co is 0.18% or more and less than 0.9%.

17. The martensitic stainless steel seamless pipe for oil country tubular goods according to claim 13, wherein the Co is 0.18% or more and less than 0.9%.

18. The martensitic stainless steel seamless pipe for oil country tubular goods according to claim 1, wherein the Co is 0.18% or more and 0.6% or less.

19. The martensitic stainless steel seamless pipe for oil country tubular goods according to claim 13, wherein the Co is 0.18% or more and 0.6% or less.

20. The martensitic stainless steel seamless pipe for oil country tubular goods according to claim 1, wherein the Cu is 0.02% or more and 0.6% or less.

* * * * *